US009482161B2

(12) United States Patent
Nagai et al.

(10) Patent No.: US 9,482,161 B2
(45) Date of Patent: Nov. 1, 2016

(54) ACTUATOR OF LINK MECHANISM FOR INTERNAL COMBUSTION ENGINE AND ACTUATOR FOR VARIABLE COMPRESSION RATIO MECHANISM

(71) Applicant: HITACHI AUTOMOTIVE SYSTEMS, LTD., Hitachinaka-shi, Ibaraki (JP)

(72) Inventors: Kishiro Nagai, Atsugi (JP); Yoshihiko Yamada, Fujisawa (JP); Junichiro Onigata, Atsugi (JP)

(73) Assignee: HITACHI AUTOMOTIVE SYSTEMS, LTD., Hitachinaka-Shi, Ibaraki (JP)

( * ) Notice: Subject to any disclaimer, the term of this patent is extended or adjusted under 35 U.S.C. 154(b) by 101 days.

(21) Appl. No.: 14/613,079

(22) Filed: Feb. 3, 2015

(65) Prior Publication Data

US 2015/0219022 A1 Aug. 6, 2015

(30) Foreign Application Priority Data

Feb. 4, 2014 (JP) ..... 2014-018991

(51) Int. Cl.
*F02B 75/04* (2006.01)
*F02D 15/02* (2006.01)

(52) U.S. Cl.
CPC ..... *F02D 15/02* (2013.01); *F02B 75/045* (2013.01); *F02B 75/048* (2013.01)

(58) Field of Classification Search
CPC ..... F02B 75/045; F02B 75/048; F02D 15/02
USPC ..... 123/48 R, 48 B, 78 R, 78 BA
See application file for complete search history.

(56) References Cited

U.S. PATENT DOCUMENTS

2002/0043228 A1* 4/2002 Moteki ..... F02B 75/045 123/78 E
2013/0327302 A1* 12/2013 Hiyoshi ..... F02B 75/04 123/48 R
2015/0176507 A1* 6/2015 Tanaka ..... F02F 7/0068 123/48 R

FOREIGN PATENT DOCUMENTS

JP 2011-169152 A 9/2011

OTHER PUBLICATIONS

U.S. Appl. No. 14/613,035, filed Feb. 3, 2015, Onigata et al.

* cited by examiner

*Primary Examiner* — Marguerite McMahon
(74) *Attorney, Agent, or Firm* — Foley & Lardner LLP

(57) ABSTRACT

An actuator of a variable compression ratio mechanism which includes: a control link; a control shaft; a housing; a wave gear speed reduction device arranged to transmit the reduced rotation speed to the control shaft; a first bearing portion which is provided between the control shaft and a wave generation device of the wave gear speed reduction device, and which rotatably supports a first axial end portion of the wave generation device; and a second bearing portion which is provided between the housing and the wave generation device, and which rotatably supports an second axial end portion of the wave generation device, at least one of the first bearing portion and the second bearing portion being disposed inside an axial width of an outer circumference portion of the wave generation device.

16 Claims, 7 Drawing Sheets

ACTUATOR OF LINK MECHANISM FOR INTERNAL COMBUSTION ENGINE AND ACTUATOR FOR VARIABLE COMPRESSION RATIO MECHANISM

BACKGROUND OF THE INVENTION

This invention relates to a link mechanism for an internal combustion engine which is used for a variable valve actuating apparatus that is arranged to vary operation characteristics of engine valve of an intake valve and/or an exhaust valve of an internal combustion engine, and an actuator for a variable compression ratio mechanism which is arranged to vary an actual mechanical compression ratio of the internal combustion engine.

A Japanese Patent Application Publication No. 2011-169152 discloses a conventional variable compression ratio mechanism which uses multi-link piston-crank mechanism, and which is arranged to vary a mechanical compression ratio.

That is, a piston and a crank shaft are connected through an upper link and a lower link. A posture of the lower link is controlled by an actuator including a driving motor and a speed reduction device. With this, a piston stroke characteristic of the piston is varied to control the engine compression ratio.

SUMMARY OF THE INVENTION

However, in the above-described actuator of the conventional compression ratio mechanism, the control shaft is rotatably supported within the housing. The speed reduction device is provided at one end portion of the housing. The drive motor is coaxially disposed at an end portion of the speed reduction device. Accordingly, the entire axial length of the actuator becomes long. Consequently, a layout within the lower portion of the engine main body is restricted. The disposition may be difficult.

It is, therefore, an object of the present invention to provide a link mechanism and an actuator of a variable compression ratio mechanism which are devised to solve the above-described problems, to decrease the entire size by decreasing an axial length of the actuator.

According to one aspect of the present invention, an actuator of a variable compression ratio mechanism which is arranged to vary at least one of a top dead center position and a bottom dead center position of a piston of an internal combustion engine, and thereby to vary a mechanical compression ratio, the actuator comprises: a control link including a first end portion connected to the variable compression ratio mechanism, and a second end portion, and arranged to vary a position characteristic of the piston; a control shaft which is connected in an eccentric state through an arm link to the second end portion of the control link; a housing which includes a support hole formed within the housing, and which rotatably supports the control shaft; a wave gear speed reduction device which is arranged to reduce a rotation speed of a drive motor, and to transmit the reduced rotation speed to the control shaft; a first bearing portion which is provided between the control shaft and a wave generation device of the wave gear speed reduction device, and which rotatably supports a first axial end portion of the wave generation device; and a second bearing portion which is provided between the housing and the wave generation device, and which rotatably supports an second axial end portion of the wave generation device, at least one of the first bearing portion and the second bearing portion being disposed inside an axial width of an outer circumference portion of the wave generation device.

According to another aspect of the invention, An actuator of a variable compression ratio mechanism which is arranged to vary at least one of a top dead center position and a bottom dead center position of a piston of an internal combustion engine, and thereby to vary a mechanical compression ratio, the actuator comprises: a control shaft arranged to be drivingly rotated by a drive motor; a control link which includes a first end portion connected to the variable compression ratio mechanism, and a second end portion linked with the control shaft, and which is arranged to vary a position characteristic by a rotation of the control shaft; a housing which includes a support hole formed within the housing, and which rotatably supports the control shaft; a wave gear speed reduction device which is arranged to reduce a rotation speed of a drive motor, and to transmit the reduced rotation speed to the control shaft; a first bearing portion including an outer wheel which is fixed on an inner circumference portion of the control shaft, and an inner wheel which is fixed to a first axial end portion of an inner circumference portion of the wave generation device; and a second bearing portion including an outer wheel fixed to the housing, and an inner wheel fixed to a second axial end portion of the inner circumference portion of the wave generation device, at least one of the first axial end portion and the second axial end portion of the inner circumference portion of the wave generation device including a recessed portion, and a part of at least one of the first bearing portion and the second bearing portion being received within the recessed portion.

According to still another aspect of the invention, an actuator used for driving a link mechanism of an internal combustion engine, the actuator comprises: a control link including a first end portion connected to the link mechanism; a control shaft which is rotatably connected to a second end portion of the control link through an arm link; a housing rotatably supporting therewithin the control shaft; a wave gear speed reduction device arranged to reduce a rotation speed of the drive motor, and to transmit the reduced rotation speed to the control shaft; a first bearing portion provided between the control shaft and a first axial end portion of the wave generation device of the wave gear speed reduction device; and a second bearing portion provided between the housing and a second axial end portion of the wave generation device, a part of at least one of the first bearing portion and the second bearing portion being disposed within an axial width of an outer circumference portion of the wave generation device.

DETAILED DESCRIPTION OF THE INVENTION

Hereinafter, an actuator of a variable compression ratio mechanism according to one embodiment of the present invention is illustrated with reference to the drawings. In this embodiment, there are provided a variable compression ratio mechanism (VCR) arranged to vary a mechanical compression ratio of an in-line four cylinder gasoline internal combustion engine, and an actuator thereof.

First Embodiment

Figure 1:
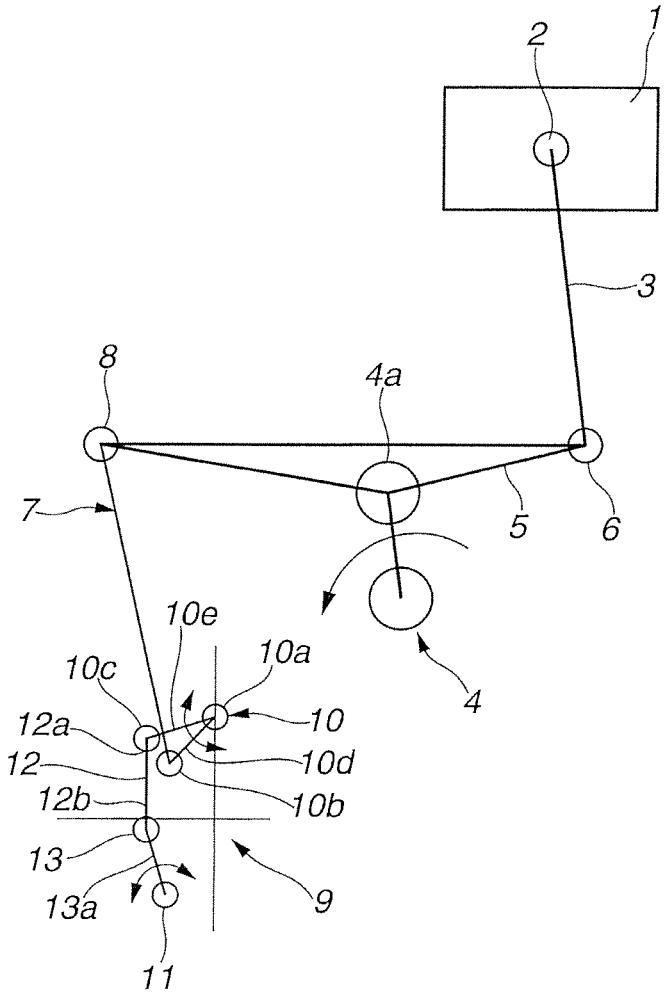
FIG. 1 is a schematic view schematically showing an embodiment according to the present invention.

FIG. 1 schematically shows a variable compression ratio mechanism according to the present invention. This is identical to a structure of FIG. 1 of the conventional art of Japanese Patent Application Publication No. 2011-169152. Accordingly, this is briefly illustrated.

There are provided an upper link 3 including an upper end which is rotatably connected to a piston pin 2 of a piston 1 that reciprocates within a cylinder of a cylinder block of an internal combustion engine; and a lower link 5 which is rotatably connected to a crank pin 4*a* of a crank shaft 4. Lower link 5 is rotatably connected with a lower end of upper link 3 through a connection pin 6. Lower link 5 is rotatably connected to an upper end portion of a first control link 7 through a connection pin 8.

First control link 7 includes a lower end portion connected with a connection mechanism 9 constituted by a plurality of link members. This connection mechanism 9 includes a first control shaft 10; a second control shaft 11 which is a control shaft; and a second control link 12 which is a control link connecting first control shaft 10 and second control shaft 11.

First control shaft 10 extends within the engine in parallel with crank shaft 4 in a cylinder row direction. First control shaft 10 includes a first journal portion 10*a* rotatably supported by a main body of the engine; a plurality of control eccentric shaft portion 10*b* each of which a lower end portion of first control link 7 of the each cylinder is rotatably mounted to; and an eccentric shaft portion 10*c* to which a first end portion 12*a* of second control link 12 is rotatably mounted.

Each of control eccentric shaft portions 10*b* is provided through first arm portion 10*d* at a position which is eccentric (depart) from first journal portion 10*a* by a predetermined amount. Similarly, eccentric shaft portion 10C is provided through second arm portion 10*e* at a position which is eccentric from first journal portion 10*a* by a predetermined amount.

Second control shaft 11 is rotatably supported within a housing 20 (described later) through a plurality of journal portions. An arm link 13 is connected and fixed to the second control shaft 11. Arm link 13 is rotatably connected with second end portion 12*b* of second control link 12.

Figure 2:
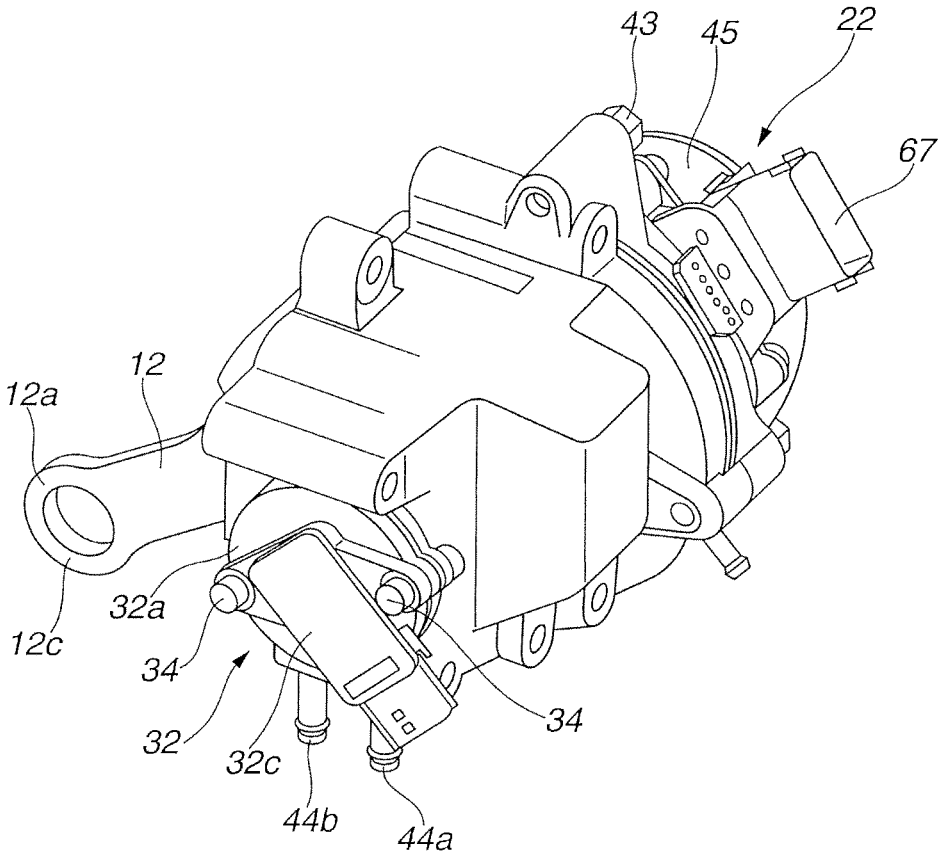
FIG. 2 is a perspective view showing an actuator of a variable compression ratio mechanism according to the present invention.
Figure 3:
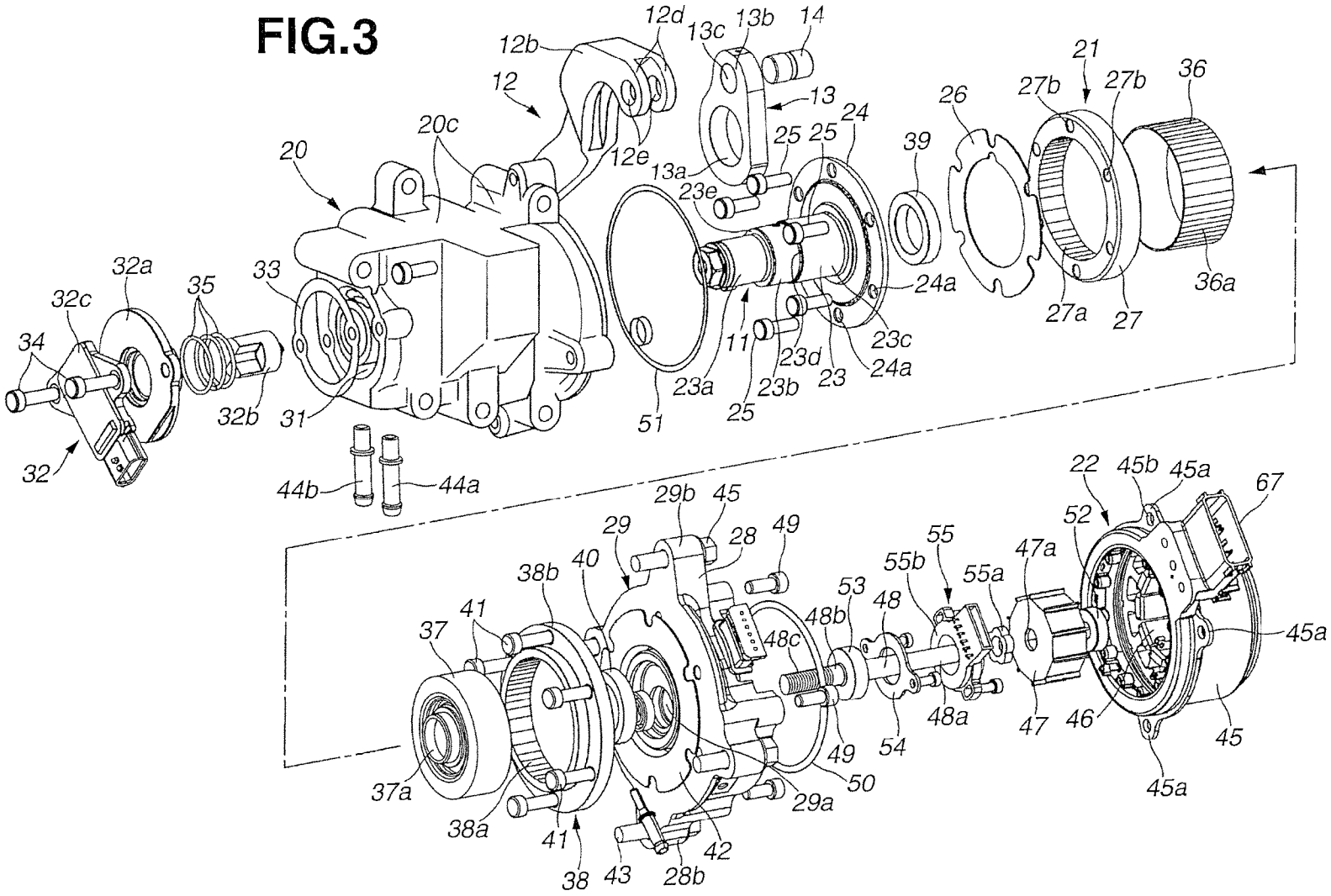
FIG. 3 is an exploded perspective view showing the actuator in the first embodiment.
Figure 4:
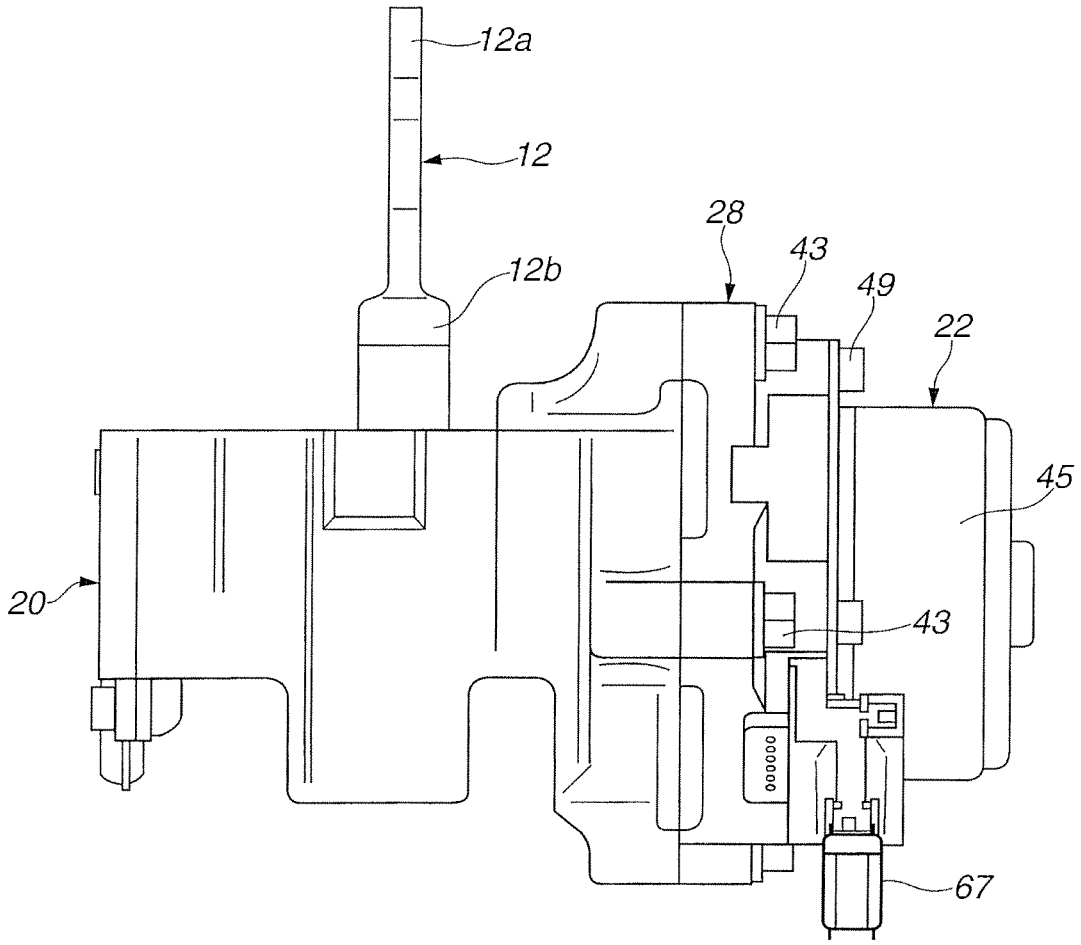
FIG. 4 is a plan view showing the actuator.
Figure 5:
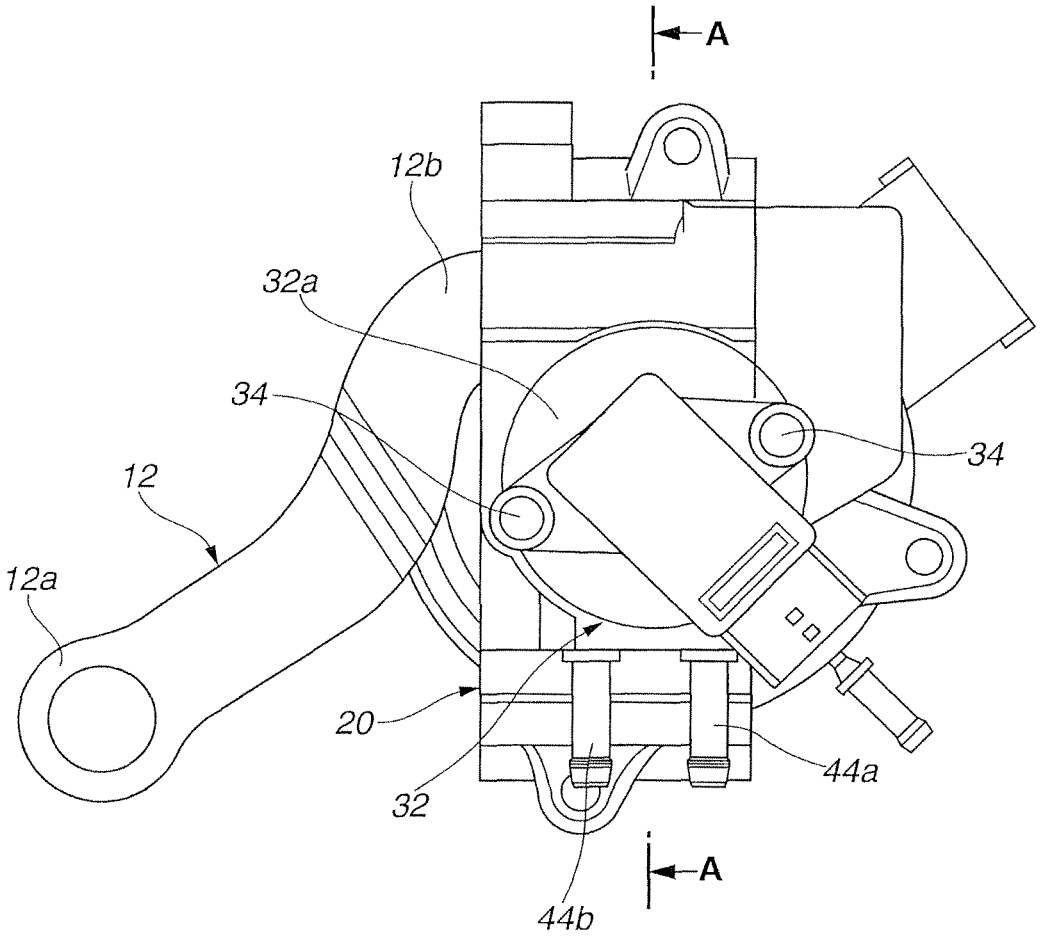
FIG. 5 is a left side view of the actuator.

As shown in FIGS. 2 and 3, second control link 12 has a lever shape. Second control link 12 includes first end portion 12*a* which has a substantially straight shape, and to which eccentric shaft portion 10*c* is connected; and a second end portion 12*b* which has a substantially arc (curved) shape by bending, and to which arm link 13 is connected. First end portion 12*a* of second control link 12 includes an insertion hole 12*c* which is formed at a tip end portion of first end portion 12*a*, which penetrates through first end portion 12*a*, and through which eccentric shaft portion 10*c* is rotatably inserted. On the other hand, second end portion 12*b* of second control link 12 includes tip end portions 12*d* and 12*d* which are formed into a bifurcated shape (two-forked shape). A protrusion portion 13*b* (described later) of arm link 13 is sandwiched and held between tip end portions 12*d* and 12*d* of second end portion 12*b*. Moreover, second end portion 12*b* includes fixing holes 12*e* and 12*e* which penetrate through second end portion 12*b*, and which a connection pin 14 connected with protrusion portion 13*a* is fit and fixed in.

Arm link 13 is formed independently of second control shaft 11. Arm link 13 is formed from an iron series metal into an annular shape having a large thickness. Arm link 13 includes a press-fit hole 13*a* which is formed in a substantially central portion of arm link 13, and which is fit and fixed on a fixing portion formed between the front and rear journal portions of second control shaft 11; and a protrusion portion 13*b* which has a U-shape, which is formed on an outer circumference of arm link 13, and which protrudes in the radial direction. Press-fit hole 13*a* and protrusion portion 13*b* are integrally formed to constitute arm link 13. This protrusion portion 13*b* includes a connection hole 13*c* in which connection pin 14 is rotatably supported. A shaft center (connection pin 14) of this connection hole 13*c* is eccentric from the shaft center of second control shaft 11 in the radial direction through protrusion portion 13*b*.

Second control shaft 11 is arranged to vary a rotational position by a torque (rotational force) transmitted from a drive motor 22 through a speed reduction device 21 which is a part of the actuator, thereby to rotate control shaft 10 through second control link 12, and to move a position of the lower end portion of first control link 7. With this, a posture of lower link 5 is varied so that the stroke characteristic of piston 1 is varied. Consequently, the engine compression ratio is varied in accordance with the variation of the stroke characteristic of piston 1.

As shown in FIG. 2 to FIG. 7, the actuator includes second control shaft 11; a housing 20 rotatably supporting second control shaft 11 within housing 20; speed reduction device 21 provided within a rear end side portion of housing 20; and drive motor 22 provided on a rear end side of speed reduction device 21.

Second control shaft 11 includes a shaft main body 23 which is integrally made from an iron series metal; and a fixing flange 24 provided integrally with a rear end portion of shaft main body 23. Shaft main body 23 is formed into a stepped shape in an axial direction. Shaft main body 23 includes a first journal portion 23*a* which is on a tip end side, and which has a small diameter; a fixing portion 23*b* which has a middle diameter, which is located at an intermediate portion, and to which arm link 13 is fit from first journal portion 23*a*'s side through press-fit hole 13*a*; and a second journal portion 23*c* which has a large diameter, and which is on the fixing flange 24's side. Moreover, shaft main body 23 includes a first stepped portion 23*d* located between fixing portion 23*b* and second journal portion 23*c*; and a second stepped portion 23*e* located between first journal portion 23*a* and fixing portion 23*b*.

First stepped portion 23*d* includes one end side hole edge which is on the second journal portion 23*c*'s side. When press-fit hole 13*a* of arm link 13 is fit on fixing portion 23*b* from the first journal portion 23*a*'s side, this one end side hole edge of first stepped portion 23*d* is abutted in the axial direction. With this, first stepped portion 23*d* restricts the movement of arm link 13 in a direction toward the second journal portion 23*c*. On the other hand, when shaft main body 23 is inserted within support hole 30, second stepped portion 23*e* is abutted on a stepped hole edge 30*c* (described later) of support hole 30 so as to restrict a movement in the axial direction.

Fixing flange 24 includes six bolt insertion holes 24*a* which are formed in an outer circumference portion of fixing flange 24 at a regular interval in the circumferential direction, and which penetrate through fixing flange 24. Fixing flange 24 is connected through a thrust plate 26 to a circular spline 27 which is an internal gear of speed reduction device 21, by the six bolts 25 inserted though the bolt insertion holes 24*a*.

Moreover, this fixing flange 24 includes a first bearing support portion 24*b* which is a circular shape, and which is formed in an inner circumference portion of fixing flange 24 on a first receiving chamber 28*a*'s side of a housing main body 28 (described later), and which protrudes. This first bearing support portion 24*b* includes a first support groove 24*c* formed on the inner circumference side of the first bearing support portion 24*b*.

Housing 20 includes housing main body 28 which is formed from an aluminum alloy into a substantially cube; and a cover 29 which closes, through an O-ring 51, one end opening of a first receiving chamber 28*a* which is a large diameter circular groove shape, and which is provided on the inner side of the rear end side of housing main body 28.

Housing main body 28 includes a second receiving chamber 28*b* which is formed within a front portion of first receiving chamber 28*a* (on a left side of FIG. 6), and which extends in a lateral direction, and a support hole 30 which is formed within housing main body 28 from a bottom surface of first receiving chamber 28*a* in the axial direction, through which the shaft main body 23 of control shaft 13 is inserted and disposed, and which penetrates through second receiving chamber 28*b* in a direction perpendicular to second receiving chamber 28*b*.

A holding hole 31 is elongated from support hole 30 in the axial direction. An angle sensor 32 is received and disposed within this holding hole 31. Angle sensor 32 is arranged to sense a rotational angle position of control shaft 13.

Cover 29 is made from an aluminum alloy similarly to housing main body 28. Cover 29 includes a motor shaft insertion hole 29*a* formed at a substantially central portion, and which penetrates through cover 29; four boss portions 29*b* which are formed on an outer circumference surface, and which protrude in the radial direction; and bolt insertion holes which are formed in the four boss portions 29*b*. Four bolts 43 are inserted from the drive motor 22's side into the bolt insertion holes. With this, cover 29 is fixed to housing main body 28.

Furthermore, this cover 29 includes a second bearing support portion 29*c* which has an annular shape, and which is formed on an inner circumference portion of an inner end surface on the first receiving chamber 28*a*'s side, and which protrudes. Cover 29 includes six internal screw holes 29*d* which are formed on an outer circumference portion of an inner end surface, and which extend in the axial direction, and in which bolts 41 for connecting a second circular spline 38 (described later) are screwed. Moreover, cover 29 includes internal screw holes 29*e* which is formed in a rear end of cover 29, and into which bolts 49 for connecting a motor housing 45 (described later) are screwed.

Second bearing support portion 29*c* protrudes in a direction toward first receiving chamber 28*a*. Second bearing support portion 29*c* includes a second support groove 29*f* which has a circular shape, and which is formed on an inner circumference side of the second bearing support portion 29*c*.

Figure 6:
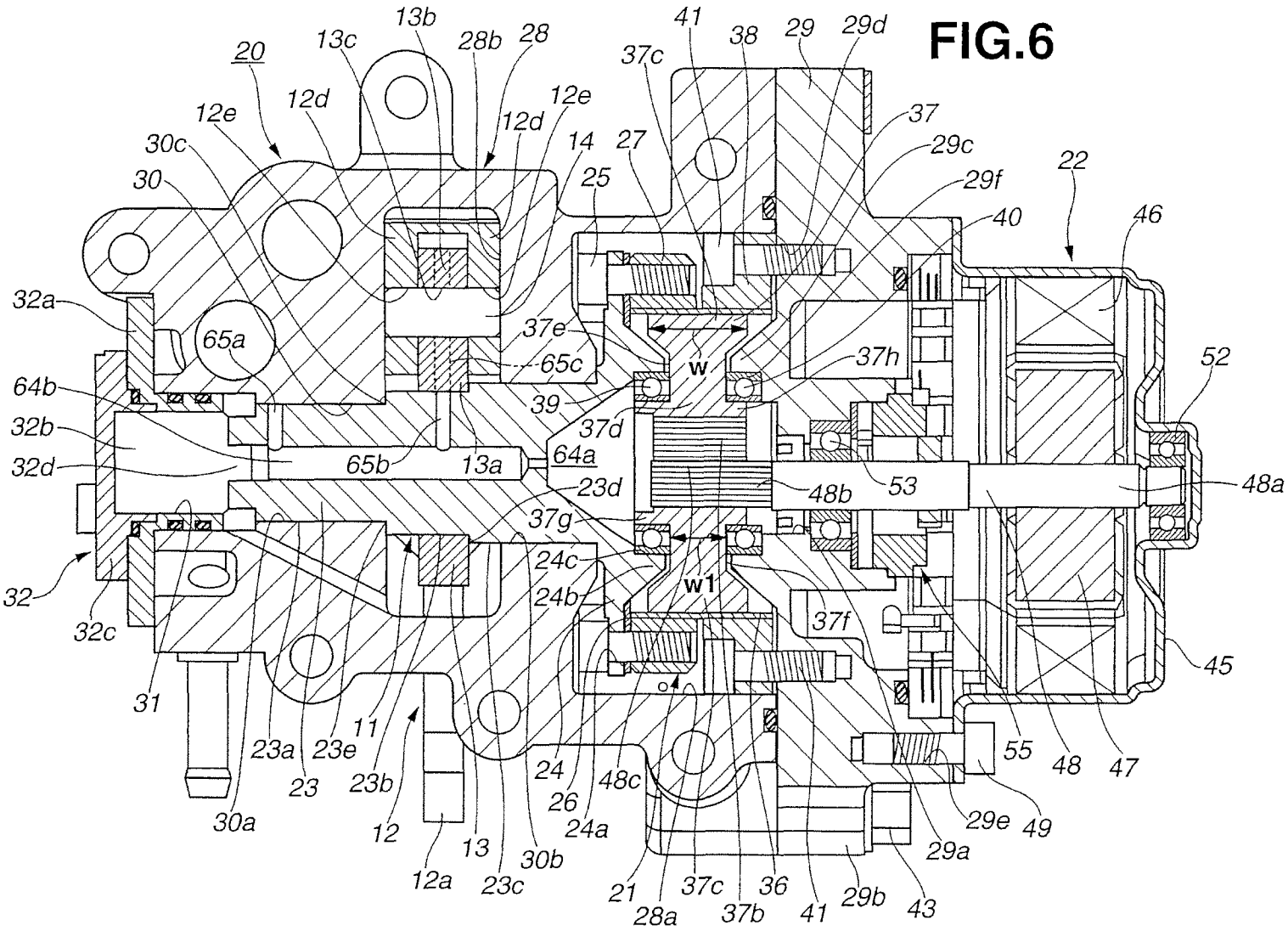
FIG. 6 is a sectional view taken along a section line A-A of FIG. 4.
Figure 7:
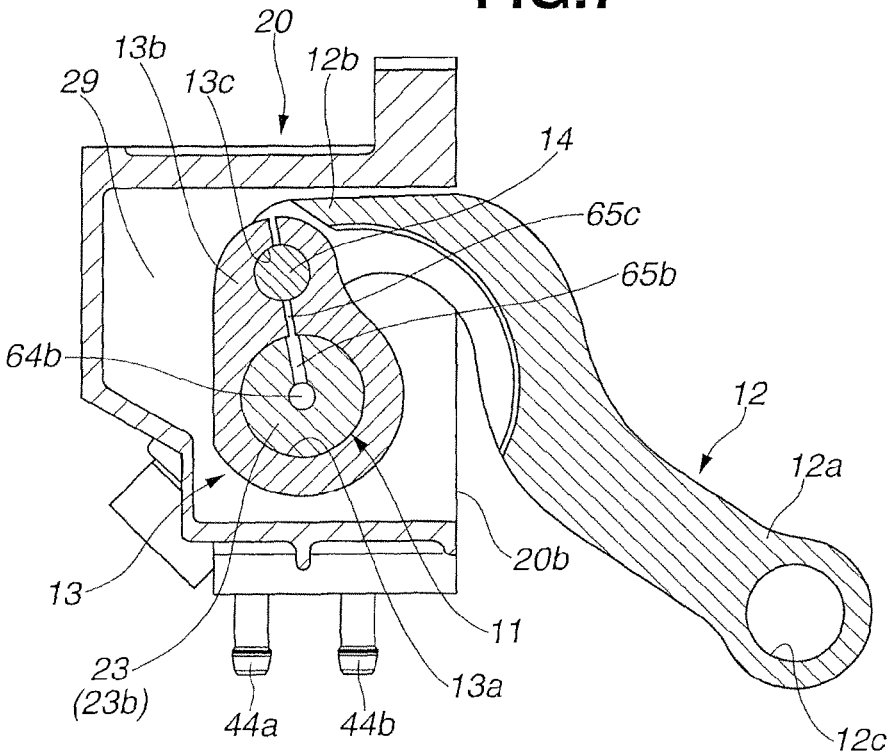
FIG. 7 is a sectional view showing a main part in the first embodiment.

As shown in FIG. 6 and FIG. 7, second receiving chamber 28*b* receives a connection portion between arm link 13 and second end portion 12*b* of control link 12 by connection pin 14. Second receiving chamber 28*b* has an overall space by which it is possible to ensure free swing movements of control link 12 and arm link 13. Moreover, second receiving chamber 28*b* has a width which is slightly greater than a width of second end portion 12*b* of control link 12 so as to suppress back-lash (rattle) of the operation.

As shown in FIG. 6, support hole 30 is formed into a stepped shape so that an outside diameter of an inner circumference surface of support hole 30 corresponds to an outside diameter of shaft main body 23 of second control shaft 11. Support hole 30 includes a first bearing hole 30*a* which has a small diameter, and on which first journal portion 23*a* is supported; a portion which is positioned at a position corresponding to the position of fixing portion 23*b*, that is, which is opened to second receiving chamber 28*b*; and a second bearing hole 30*b* which has a large diameter, and on which second journal portion 23*c* is supported.

First bearing hole 30*a* includes a stepped hole edge 30*c* confronting second receiving chamber 28*b*. This stepped hole edge 30*c* of first bearing hole 30*a* is arranged to be abutted on the second stepped portion 23*e* in the axial direction when second bearing main body 23 is inserted into support hole 30, and thereby to restrict further insertion of second shaft main body 23. Besides, the inner circumference portion of fixing flange 24 is abutted on the outside hole edge of second bearing hole 30*b*, so as to restrict a maximum movement position of shaft main body 23 with respect to support hole 30.

As shown in FIG. 2 and FIG. 3, angle sensor 32 includes a sensor cover 32*a* which has a cap shape, and which is fixed on the inner circumference surface of the holding hole 31 by the press-fit; a rotor 32*b* which is for sensing the angle, which is disposed on the inner circumference side of the sensor cover 32*a*; a sensor portion 32*c* which is provided at a substantially central portion of sensor cover 32*a*, and which is arranged to sense a rotational position of rotor 32*b*. The sensor portion 32*c* is arranged to output the sensed signal to a control unit (not shown) configured to sense an operating state of the engine. The rotor 32*b* includes a tip end protruding portion 32*d* fixed to a fixing hole formed at a tip end side of shaft main body 23 by the press-fit.

In sensor cover 32*a*, a portion between sensor cover 32*a* and holding hole 31 is sealed by a gasket 33. Sensor cover 32*a* is mounted to housing 20 with sensor portion 32*c* by two bolts 34. Moreover, sensor cover 32*a* includes three O-rings 35 which are provided on the outer circumference of a cylindrical portion. With this, the insertion of the oil in a direction toward the sensor portion 32*c* is restricted.

Speed reduction device 21 is a wave gear type. Various components of speed reduction device 21 is received within first receiving chamber 28*a* of housing main body 28 which is closed by cover 29. That is, speed reduction device 21 includes a first circular spline 27 which has an annular shape, which is fixed to fixing flange 24 by bolts, and which includes an inner circumference on which a plurality of internal teeth 27*a* are formed; a flex spline 36 which is disposed inside first circular spline 27, and which is an external gear including a plurality of external teeth 36*a* that are formed on an outer circumference surface, and that are engaged with internal teeth 27*a*; a wave generator 37 which is a wave generating device, which includes an oval outer circumference surface that is slid on a part of an inner circumference surface of flex spline 36; and a second circular spline 38 which is disposed at an axial one end side of first circular spline 27, and which includes internal teeth 38*a* that are formed on the inner circumference surface, and that the external teeth 36*a* of flex spline 36 are engaged.

First circular spline 27 includes six internal screw holes 27*b* which are formed at a regular interval in the circumferential direction, and into which bolts 25 are screwed.

Flex spline 36 is formed from metal material into a thin cylindrical shape by which the flex spline 36 can flexibly vary shape thereof. External teeth 36*a* of flex spline 36 has a number of teeth which is smaller than the number of teeth of internal teeth 27*a* of first circular spline 27 by one.

As shown in FIG. 6, wave generator 37 includes a through hole 37*a* which has a relatively large diameter, which has a substantially circular shape, and which is formed at a substantially central portion of wave generator 37; and a plurality of internal teeth 37*b* formed on the inner circumference surface of through hole 37*a*. The oval outer circumference surface of this wave generator 37 is formed into a plane shape. This oval outer circumference surface of wave generator 37 is abutted on the plane inner circumference surface of flex spline 36.

This wave generator 37 includes an outer circumference portion 37*c* having an axial width W which is relatively small. Moreover, this wave generator 37 includes an inner circumference portion 37*d*; and recessed portions 37*e* and 37*f* formed on both axial end surfaces of inner circumference portion 37*d*. With this, the entire of the wave generator 37 has a constriction shape. That is, axial width W1 of inner circumference portion 37*d* is sufficiently smaller than an axial width W of outer circumference portion 37*c* by the both recessed portions 37*e* and 37*f*. With this, the entire of the wave generator 37 is formed into the constriction shape.

Moreover, wave generator 37 includes cylindrical protruding portions 37*g* and 37*h* integrally formed, respectively, on the inside of the inner circumference portion 37*d*, that is, the front and rear hole edges of through hole 37*a* in the axial direction. Front and rear first and second ball bearings 39 and 40 (first and second bearing portions) are disposed, respectively, between the protrusion portions 37*g* and 37*h*, and the first support groove 24*c* of fixing flange 24 and second support groove 29*f* of cover 29. The entire of wave generator 37 is rotatably supported by these first and second ball bearings 39 and 40.

In particular, first ball bearing 39 includes an inner wheel which is fixed on the outer circumference surface of the one protrusion portion 37*g* by the press-fit, and an outer wheel which is fixed on the inner circumference surface of the first support groove 24*c* by the press-fit. On the other hand, second ball bearing 40 includes an inner wheel which is fixed on the outer circumference surface of the other protrusion portion 37*h* by the press-fit; and an outer wheel which is fixed on the inner circumference surface of the second support groove 29*f*. Accordingly, first and second ball bearings 39 and 40 include, respectively, inner portions which confront each other in the axial direction, and which are positioned within the axial width W of outer circumference portion 37*c*. Accordingly, first and second ball bearings 39 and 40 are overlapped with outer circumference portion 37*c* in the radial direction.

Second circular spline 38 includes a flange portion 38*b* which is provided on the outer circumference side; and six bolt insertion holes which are formed in flange portion 38*b*, and which penetrate through flange portion 38*b*. Second circular spline 38 is fixed to the inner end portion of cover 29 through second thrust plate 42 by six bolts 41 inserted through these bolt insertion holes. Furthermore, internal teeth 38*a* of this second circular spline 38 has the number of teeth which is identical to the number of teeth of the external teeth 36*a* of flex spline 36. Accordingly, the internal teeth 38*a* of this second circular spline 38 has the number of the teeth smaller than the number of the teeth of the internal teeth 27*a* of first circular spline 27 by one. By this difference of the numbers of the teeth, the speed reduction ratio is determined.

Drive motor 22 is a brushless electric motor. As shown in FIG. 3 and FIG. 6, drive motor 22 includes a motor casing 45 which has a bottomed cylindrical shape; a coil 46 which has a cylindrical shape, and which is fixed on the inner circumference surface of motor casing 45; a magnetic rotor 47 which is rotatably provided within coil 46; and a motor shaft 48 which includes one end portion 48*a* which is fixed at a substantially axial center of magnetic rotor 47.

Motor casing 45 includes four boss portions 45*a* which are formed on an outer circumference of an front end; and bolt insertion holes 45*b* which are formed in four boss portions 45*a*, and through which four bolts 49 are inserted. Motor casing 45 is mounted on a rear end portion of cover 29 through an O-ring 50 by four bolts 49. Furthermore, a connector portion 67 is integrally provided on an outer circumference of motor casing 45. Connector portion 67 is arranged to receive a control current from the control unit.

Magnetic rotor 47 includes positive magnetic poles and negative magnetic poles which are alternately disposed on the outer circumference in the circumferential direction. Moreover, magnetic rotor 47 includes a fixing hole 47*a* which is formed at a substantially central portion, and to which one end portion 48*a* of motor shaft 48 is fixed by the press-fit, and which penetrates through magnetic rotor 47.

Motor shaft 48 includes first end portion 48*a* which protrudes from one end surface of magnetic rotor 47, and which has a tip end portion supported by a ball bearing 52 including an outer wheel fixed within an end wall of motor casing 45. Moreover, motor shaft 48 includes a second end portion 48*b* which is supported by a ball bearing 53 including an outer wheel fixed on the inner circumference of motor shaft insertion hole 29*a* of cover 29. Furthermore, external teeth 48*c* are formed on the outer circumference surface of motor shaft 48 which is other than second end portion 48*b*. External teeth 48*c* are engaged with internal teeth 37*b* of wave generator 37.

Ball bearing 53 is held within a holding groove of cover 29 by screws 56 through a substantially disc shaped retainer 54.

A resolver 55 is disposed at a substantially central position of motor shaft 48 in the axial direction. Resolver 55 is arranged to sense a rotation angle of motor shaft 48. This resolver 55 includes a resolver rotor 55*a* fixed on the outer circumference of motor shaft 48 by the press-fit; and a sensor portion 55*b* arranged to sense a compound leaf shaped target formed on the outer circumference surface of resolver rotor 55*a*. This sensor portion 55*b* is fixed within the cover 28 by two screws 56. Moreover, the sensor portion 55*b* is arranged to output the sensed signal to the control unit.

Second control shaft 11 includes an introduction portion which is formed inside second control shaft 11 in the axial direction, and which is arranged to introduce the lubrication oil pressurized and transmitted from an oil pump (not shown); and a plurality of radial holes 65*a* and 65*b* which are formed inside second control shaft 11 in the radial direction, and which are connected with the introduction portion. The introduction portion includes an oil chamber 64*a* which has a substantially conical shape, which is formed at a substantially central portion of fixing flange 24, and to which a lubrication oil is supplied from an oil hole (not shown); and an axial hole 64*b* which is formed from oil chamber 64*a* along a direction of the center of the shaft of the inside of second control shaft 11.

The one radial hole 65*a* includes an inner end opened in the tip end portion of the axial hole 64*b*; and an outer end opened in a clearance between the outer circumference surface of first journal portion 23*a* and first bearing hole 30*a*. The one radial hole 65*a* is arranged to supply the lubrication oil to this clearance. As shown in FIG. 7, the other radial hole 65*b* is connected to an oil hole 65*c* formed inside the arm link 13. The other radial hole 65*b* is arranged to supply the lubrication oil through this oil hole 65*c* to a portion between the inner circumference surface of connection hole 13*c* and the outer circumference surface of the connection pin 14.

[Functions and Effects of First Embodiment]

Figure 8:
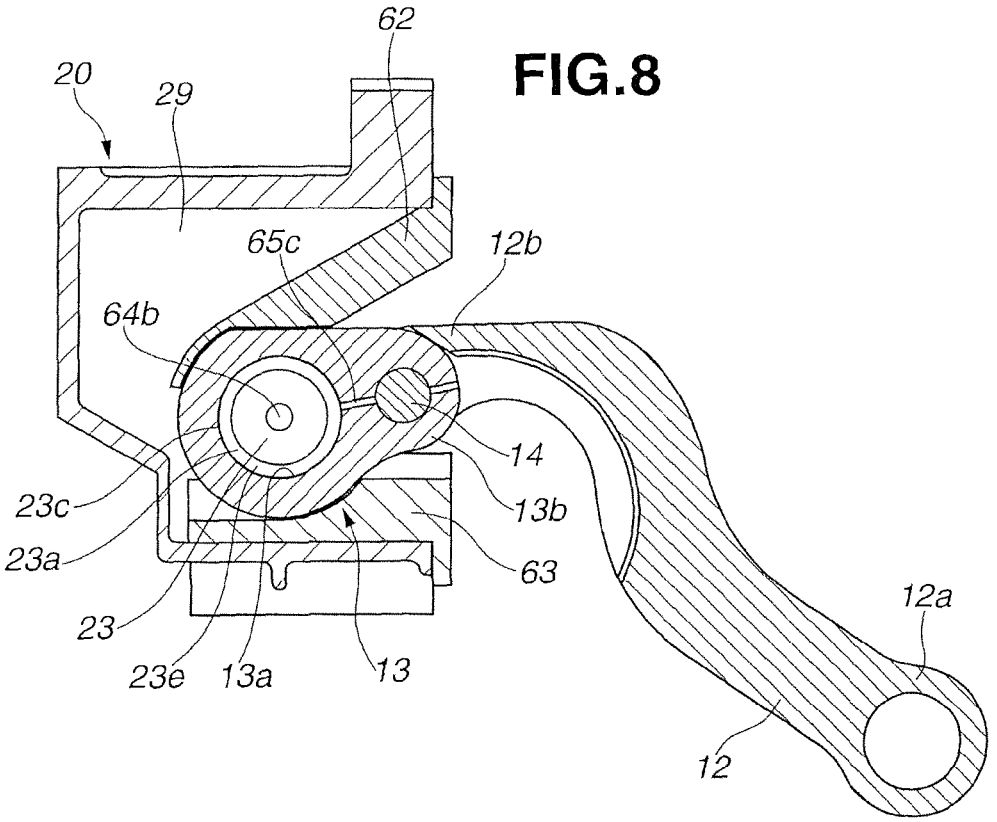
FIG. 8 is a sectional view showing a state in which a control shaft is assembled to a control shaft in the first embodiment.

By this embodiment, when arm link 13 is fixed within receiving chamber 28*b* to shaft main body 23 of second control shaft 11 by the press-fit, first in a state where second end portion 12*b* of control link 12 and protrusion portion 13*b* of arm link 13 are connected with each other by connection pin 14, this connection portion is received, positioned, and fixed within receiving chamber 28*b* by two jigs 62 and 63, as shown in FIG. 8. In this state, shaft main body 23 is inserted into press-fit hole 13*a* from the tip end portion's side (the first journal portion 23*a*'s side). This connection portion (arm link 13) is press-fit on the outer circumference surface of fixing portion 23*b* in the axial direction. This connection portion (arm link 13) is press-fit until first stepped portion 23*d* is abutted on the one end side hole edge.

Then, jigs 62 and 63 are detached. With this, the assembling operation of arm link 13 with respect to second control shaft 11 is finished.

In this way, in this embodiment, second control shaft 11 and arm link 13 are divided into each other. Arm link 13 is connected to shaft main body 23 within receiving chamber 28*b*. Unlike the conventional art in which shaft main body 23 and arm link 13 are integrally formed, it is unnecessary that the inside diameter of motor shaft insertion hole 30 of housing main body 28 is formed into a large size for inserting arm link 13. Moreover, it is utterly unnecessary that housing main body 28 is divided into the upper section and the lower section.

Accordingly, it is possible to suppress the increase of the entire size of the housing 20, and to attain the size reduction and the weight reduction of housing 20. Accordingly, it is possible to improve mountability of the variable compression ratio mechanism to the engine.

Furthermore, second control shaft 11 and arm link 13 are different members. With this, it is possible to improve the freedom of the length of arm link 13, and to increase the length of arm link 13 in accordance with the size of receiving chamber 28*b*. Accordingly, it is possible to reduce the reverse input load from control link 12 toward second control shaft 11's side. With this, it is possible to reduce the load of speed reduction device 21 and drive motor 22.

Moreover, in this embodiment, the entire axial width of wave generator 37 is small. In particular, wave generator 37 is formed into a contraction shape by the recessed portions 37*e* and 37*f* formed on the both end surfaces of inner circumference portion 37*d*. Accordingly, the axial width W1 becomes small. Consequently, it is possible to close the positions of first and second ball bearings 39 and 40. Therefore, it is possible to close cover 29 and fixing flange 27 which support, respectively, first and second ball bearings 39 and 40. Accordingly, it is possible to sufficiently decrease the axial length of the entire of housing 20. Consequently, it is possible to decrease the axial size of the entire of housing, in cooperation with the size reduction of housing main body 28.

Furthermore, it is possible to slightly move the position of fixing flange 27 toward the cover 29's side. Accordingly, it is possible to further increase the axial length of second bearing hole 30*b*. With this, it is possible to increase bearing area of second journal portion 23*c* by second bearing hole 30*b*. Accordingly, it is possible to receive the larger load by second bearing hole 30*b*.

That is, large alternating torque generated in piston 1 is transmitted to control link 12. This alternating torque is transmitted from arm link 13 to shaft main body 23 of second control shaft 11. The large load is transmitted from first and second journal portions 23*a* and 23*c* to the inner circumference surfaces of first and second bearing holes 30*a* and 30*b*, so that the surface pressures between the inner circumference surfaces of first and second bearing holes 30*a* and 30*b* becomes large. The abrasion is generated on the inner circumference surfaces of first and second bearing holes 30*a* and 30*c* of the aluminum alloy by this surface pressures and high speed sliding friction. With this, a relatively large clearance may be generated between first and second journal portions 23*a* and 23*c* and first and second bearing holes 30*a* and 30*b*.

In a case where this clearance becomes large, in second control shaft 11, the first journal portion 23*a*'s side which is a tip end portion of shaft main body 23 becomes easy to be pivoted about second ball bearing 40. With this, flex spline 36 receives the alternating load through first ball bearing 39, and wave generator 37. Conventionally, the inner circumferential portion of wave generator 37 has a long axial length. Accordingly, the swing amount around second ball bearing 40 becomes large. The large eccentric load is acted to flex spline 36. The flexible shape variation (deformation) becomes easy to be partially generated. Moreover, the deterioration of the durability of those may be generated by the increase of the local surface pressure and the poor lubrication due to partial contact (misaligned abutment) of track surface of first ball bearing 39.

Accordingly, in this embodiment, the position of first ball bearing 39 is closer to the drive motor 22's side. With this, fixing flange 24 can be moved in the same direction. Consequently, it is possible to increase the axial length of second bearing hole 30*d*. Therefore, it is possible to decrease an overhang amount from second ball bearing 40 which is a fulcrum to flex spline 36 and first ball bearing 39 which are points of action, and thereby to suppress the swing amount of shaft main body 23 to a small amount. Accordingly, it is possible to decrease the partially flexible amount of flex spline 36, and to suppress the generation of the partial contact of second ball bearing 40. With this, it is possible to suppress the decrease of the durability of those.

Furthermore, shaft main body 23 is supported through the front and rear first and second journal portions 23*a* and 23*c* in front and rear first and second bearing holes 30*a* and 30*b* of support hole 30. Accordingly, it is possible to stably constantly support second control shaft 11, and thereby to further suppress the vibration and noise by the alternating load.

Moreover, in this embodiment, shaft main body 23 has a stepped shape from second journal portion 23*c* having the maximum diameter through the fixing portion 23*b* having the middle diameter to the first journal portion 23*a* having the minimum diameter. Accordingly, it is possible to improve the insertion characteristics to support hole 30.

Furthermore, arm link 13 is fixed through press-fit hole 13*a* on fixing portion 23*b* of shaft main body 23 in the axial direction. Accordingly, it is possible to ease the connection operation of arm link 13 and shaft main body 23.

Moreover, second stepped portion 23*e* of shaft main body 23 is abutted on stepped hole edge 30*c* of support hole 30. With this, it is possible to ease the positioning in the axial direction at the insertion of shaft main body 23. Furthermore, it is possible to restrict the axial position of arm link 13 at the press-fit by using first stepped portion 23*d* of shaft main body 23. Accordingly, it is possible to ease the positioning at this point.

Moreover, shaft main body 23 of second control shaft 11 is made from iron series metal. On the other hand, the entire of housing 20 including first and second bearing holes 30*a* and 30*b* are formed from aluminum alloy. With this, difference between the iron and the aluminum alloy by thermal expansion and contraction becomes small since the first bearing hole 30*a* has a small diameter shape. With this, it is possible to suppress the generation of the twist due to the backlash between first journal portion 23*a* and first bearing hole 30*a*.

The present invention is not limited to the structure according to the embodiment. For example, it is optional to employ a spline connection and a bolt connection, as a fixing means of arm link 13 with respect to shaft main body 23, in addition to the press-fit.

Moreover, the present invention is applicable to actuators of other link mechanisms for internal combustion engine, in addition to the variable compression ratio mechanism.

[a] In the actuator of the variable compression ratio mechanism, the second bearing portion includes an outer wheel which is fixed on the housing, and an inner wheel which is fixed on a first axial end portion of an inner circumference portion of the wave generation device; and the first axial end portion of the wave generation device is rotatably supported by the housing.

[b] In the actuator of the variable compression ratio mechanism, the first bearing portion includes an outer wheel fixed on an inner circumference portion of the control shaft, and an inner wheel fixed at a second axial end portion of the inner circumference portion of the wave generation device; and the second axial end portion of the wave generation device is rotatably supported by the control shaft.

[c] In the actuator of the variable compression ratio mechanism, the control shaft is rotatably supported within the housing by a front bearing hole and a rear bearing hole which are formed within the housing at front and rear positions in an axial direction to sandwich the arm link.

[d] In the actuator of the variable compression ratio mechanism, the control link is rotatably connected to an eccentric portion of the arm link fixed to the control shaft.

[e] In the actuator of the variable compression ratio mechanism, the actuator further includes an angle sensor provided to a tip end portion of the control shaft, and arranged to sense an rotation angle of the control shaft.

[f] In the actuator of the variable compression ratio mechanism, the variable compression ratio mechanism includes a first control shaft which is different from the control shaft, and which is arranged to be rotated to vary a position of a piston; the control link is connected to the first control shaft to be eccentric from the first control shaft; and the control link is arranged to vary a posture of the control link to vary a rotation angle of the first control shaft.

[g] In the actuator of the variable compression ratio mechanism, the housing includes a speed reduction device receiving portion which is formed within the housing, and which receives the wave gear speed reduction device; and the housing includes a bearing hole which is on the rear end side of the housing, and which extends toward the speed reduction device receiving portion.

By this invention, the axial bearing hole of the control shaft extends toward the wave generating device. Accordingly, it is possible to increase the axial length of the bearing hole. Consequently, it is possible to receive the larger load by this bearing hole.

In this embodiment according to the present invention, the bearing hole of the control shaft extends in a direction toward the wave generation device of the speed reduction device. Accordingly, it is possible to increase the axial length of the bearing hole, and thereby to receive the larger load.

[h] In the actuator of the variable compression ratio mechanism, the control shaft includes a first journal portion and a second journal portion which are supported by two bearing holes of the housing. The first journal portion is located at a tip end portion. The second journal portion is located at a base end portion. The second journal portion has an outside diameter larger than an outside diameter of the first journal portion.

In this invention, the outside diameter of the first journal portion is larger than the outside diameter of the second journal portion. Accordingly, it is possible to receive the larger load.

[i] In the actuator of the variable compression ratio mechanism, the control link is rotatably connected to an eccentric portion of the arm link which is fixed to the control shaft by the press-fit.

[j] In the actuator of the variable compression ratio mechanism, the control shaft includes a fixing flange located at a base end portion on the speed reduction device's side; and the fixing flange includes an outer circumference side fixed on an outer circumference of the circular spline.

[k] In the actuator of the variable compression ratio mechanism, the fixing flange includes a first support groove which is formed on an inner circumference side of the fixing flange, and which supports the outer circumference of the first bearing portion.

[l] In the actuator of the variable compression ratio mechanism, the wave generation device includes a bearing portion which is formed on the inner circumference side of the wave generation device, and which extends toward the control shaft's side; and the bearing portion includes an outer circumference on which the inner wheel of the second bearing portion is fixed.

[m] In the actuator of the variable compression ratio mechanism, the second bearing portion includes an end portion which is on the wave generation device's side, and which is disposed to be overlapped with a sliding range between the wave generation device and the external teeth.

[n] In the actuator of the variable compression ratio mechanism, the control shaft includes an oil passage which is formed within the control shaft, and which extends in the axial direction.

[o] In the actuator of the variable compression ratio mechanism, the arm link includes an oil hole which is formed in the arm link, and which connects the oil passage and the connection portion between the control link and the arm link.

[p] In the actuator of the variable compression ratio mechanism, the flange portion includes a recessed portion forming portion which forms the recessed portion, which protrudes toward the wave generation device with respect to the outer circumference of the flange portion; and the wave forming portion is disposed so that a part of the recessed portion forming section is overlapped with the inside of the first internal gear in the axial direction.

The entire contents of Japanese Patent Application No. 2014-018991 filed Feb. 4, 2014 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An actuator of a variable compression ratio mechanism which is arranged to vary at least one of a top dead center position and a bottom dead center position of a piston of an internal combustion engine, and thereby to vary a mechanical compression ratio, the actuator comprising:

a control link including a first end portion connected to the variable compression ratio mechanism, and a second end portion, and arranged to vary a position characteristic of the piston;

a control shaft which is connected in an eccentric state through an arm link to a second end portion of the control link;

a housing which includes a support hole formed within the housing, and which rotatably supports the control shaft;

a wave gear speed reduction device which is arranged to reduce a rotation speed of a drive motor, and to transmit the reduced rotation speed to the control shaft;

a first bearing portion which is provided between the control shaft and a wave generation device of the wave gear speed reduction device, and which rotatably supports a first axial end portion of the wave generation device; and a second bearing portion which is provided between the housing and the wave generation device, and which rotatably supports a second axial end portion of the wave generation device, at least one of the first bearing portion and the second bearing portion being disposed inside an axial width of an outer circumference portion of the wave generation device.

2. The actuator for the variable compression ratio mechanism as claimed in claim 1, wherein the control shaft is rotatably supported within the housing by a front bearing hole and a rear bearing hole which are formed within the housing at front and rear positions in an axial direction to sandwich the arm link.

3. The actuator for the variable compression ratio mechanism as claimed in claim 2, wherein the housing includes a speed reduction device receiving portion which is formed within the housing, and which receives the wave gear speed reduction device; and the rear bearing hole which is on the rear end side of the housing extends toward the speed reduction device receiving portion.

4. The actuator for the variable compression ratio mechanism as claimed in claim 1, wherein the housing includes a speed reduction device receiving portion which is formed within the housing, and which receives the wave gear speed reduction device; and the rear bearing hole which is on the rear end side of the housing extends toward the speed reduction device receiving portion.

5. The actuator for the variable compression ratio mechanism as claimed in claim 4, wherein the second bearing portion includes an outer wheel which is fixed on the housing, and an inner wheel which is fixed on a first axial end portion of an inner circumference portion of the wave generation device; and the first axial end portion of the wave generation device is rotatably supported by the housing.

6. The actuator for the variable compression ratio mechanism as claimed in claim 5, wherein the first bearing portion includes an outer wheel fixed on an inner circumference portion of the control shaft, and an inner wheel fixed at a second axial end portion of the inner circumference portion of the wave generation device; and the second axial end portion of the wave generation device is rotatably supported by the control shaft.

7. The actuator for the variable compression ratio mechanism as claimed in claim 5, wherein the control shaft includes a fixing flange located at a base end portion on the speed reduction device's side; and the fixing flange includes an outer circumference side fixed on an outer circumference of a circular spline.

8. The actuator for the variable compression ratio mechanism as claimed in claim 7, wherein the fixing flange includes a first support groove which is formed on an inner circumference side of the fixing flange, and which supports the outer circumference of the first bearing portion.

9. The actuator for the variable compression ratio mechanism as claimed in claim 1, wherein the wave gear speed reduction device includes a first inner gear which has an internal teeth formed on an inner circumference surface, and which is arranged to rotate as a unit with the control shaft, a second inner gear which is fixed to the housing, and which has an internal teeth which is formed on an inner circumference surface, and whose a number of the teeth is smaller than a number of the teeth by one, and an external gear that extends within the first inner gear and the second inner gear, that is disposed coaxially with the first inner gear and the second inner gear, and that has external teeth which is formed on an outer circumference surface of the external gear, and whose a number of the teeth is identical to the number of the teeth of the second internal gear;

the wave generation device includes an outer circumference surface which is disposed on an inner circumference surface of the external teeth to be slid on the inner circumference surface of the external gear; and the wave generation device is arranged to engage the external teeth of the outer gear with the internal teeth of the first inner gear and the internal teeth of the second inner gear by the rotation of the motor.

10. The actuator for the variable compression ratio mechanism as claimed in claim 1, wherein the control link is rotatably connected to an eccentric portion of the arm link fixed to the control shaft.

11. The actuator for the variable compression ratio mechanism as claimed in claim 1, wherein the actuator further comprises an angle sensor provided to a tip end portion of the control shaft, and arranged to sense an rotation angle of the control shaft.

12. The actuator for the variable compression ratio mechanism as claimed in claim 1, wherein the variable compression ratio mechanism includes a first control shaft which is different from the control shaft, and which is arranged to be rotated to vary a position of a piston; the control link is connected to the first control shaft to be eccentric from the first control shaft; and the control link is arranged to vary a posture of the control link to vary a rotation angle of the first control shaft.

13. An actuator of a variable compression ratio mechanism which is arranged to vary at least one of a top dead center position and a bottom dead center position of a piston of an internal combustion engine, and thereby to vary a mechanical compression ratio, the actuator comprising:

a control shaft arranged to be drivingly rotated by a drive motor;

a control link which includes a first end portion connected to the variable compression ratio mechanism, and a second end portion linked with the control shaft, and which is arranged to vary a position characteristic by a rotation of the control shaft;

a housing which includes a support hole formed within the housing, and which rotatably supports the control shaft;

a wave gear speed reduction device which Is arranged to reduce a rotation speed of a drive motor, and to transmit the reduced rotation to the control shaft;

a first bearing portion including an outer wheel which is fixed on an inner circumference portion of the control shaft, and an inner wheel which is fixed to a first axial end portion of an inner circumference portion of a wave generation device; and a second bearing portion including an outer wheel fixed to the housing, and an inner wheel fixed to a second axial end portion of the inner circumference portion of the wave generation device, at least one of the first axial end portion and the second axial end portion of the inner circumference portion of the wave generation device including a recessed portion, and a part of at least one of the first bearing portion and the second bearing portion being received within the recessed portion.

14. The actuator for the variable compression ratio mechanism as claimed in claim 13, wherein the housing includes a speed reduction device receiving portion which is formed within the housing, and which receives the wave gear speed reduction device; and the housing includes a bearing hole which is on the rear end side of the housing, and which extends toward the speed reduction device receiving portion.

15. An actuator used for driving a link mechanism of an internal combustion engine, the actuator comprising:

a control link including a first end portion connected to the link mechanism;

a control shaft which is rotatably connected to a second end portion of the control link through an arm link;

a housing rotatably supporting therewithin the control shaft;

a wave gear speed reduction device arranged to reduce a rotation speed of the drive motor, and to transmit the reduced rotation speed to the control shaft;

a first bearing portion provided between the control shaft and a first axial end portion of the wave generation device of the wave gear speed reduction device; and a second bearing portion provided between the housing and a second axial end portion of a wave generation device, a part of at least one of the first bearing portion and the second bearing portion being disposed within an axial width of an outer circumference portion of the wave generation device.

16. The actuator for the variable compression ratio mechanism as claimed in claim 15, wherein the housing includes a speed reduction device receiving portion which is formed within the housing, and which receives the wave gear speed reduction device; and the housing includes a bearing hole which is on a rear end side of the housing, and which extends toward the speed reduction device receiving portion's side.

* * * * *